US012515091B1

(12) United States Patent
Nolan et al.

(10) Patent No.: US 12,515,091 B1
(45) Date of Patent: Jan. 6, 2026

(54) CABLE SYSTEM FOR EXERCISE MACHINES

(71) Applicant: Bulletproof Fitness Equipment Inc, Acton, CA (US)

(72) Inventors: Lawrence R. Nolan, Santa Clarita, CA (US); Nicole K. Nolan, Santa Clarita, CA (US); Christopher I. Gaddy, Brooklyn, NY (US)

(73) Assignee: Bulletproof Fitness Equipment Inc, Acton, CA (US)

( * ) Notice: Subject to any disclaimer, the term of this patent is extended or adjusted under 35 U.S.C. 154(b) by 216 days.

(21) Appl. No.: 18/451,666

(22) Filed: Aug. 17, 2023

Related U.S. Application Data

(63) Continuation-in-part of application No. 17/955,302, filed on Sep. 28, 2022, which is a continuation-in-part of application No. 17/034,950, filed on Sep. 28, 2020, now Pat. No. 11,517,785.

(60) Provisional application No. 63/336,679, filed on Apr. 29, 2022.

(51) Int. Cl.
*A63B 21/00* (2006.01)
*A63B 21/062* (2006.01)

(52) U.S. Cl.
CPC ..... *A63B 21/155* (2013.01); *A63B 21/0628* (2015.10); *A63B 21/156* (2013.01)

(58) Field of Classification Search
CPC . A63B 21/155; A63B 21/0628; A63B 21/156; A63B 21/0626; A63B 21/063; A63B 21/0632
See application file for complete search history.

(56) References Cited

U.S. PATENT DOCUMENTS 4,834,367 A * 5/1989 Salyer ..... A63B 21/156 482/100
5,788,614 A 8/1998 Simonson
5,820,529 A * 10/1998 Weintraub ..... A63B 21/0552 482/904
6,238,323 B1 5/2001 Simonson
(Continued)

FOREIGN PATENT DOCUMENTS

WO 2019199352 A1 10/2019
WO 2023163728 A1 8/2023

OTHER PUBLICATIONS

International Search Report, dated Jul. 12, 2022, issued in International Patent Application PCT/2022/023315, 1 page.

*Primary Examiner* — Megan Anderson
(74) *Attorney, Agent, or Firm* — AVEK IP, LLC

(57) ABSTRACT

A cable system for use with an exercise machine include a cable cam for engagement with the exercise machine and to support a first attachment, the cable cam having a carriage to engage with a vertical post and to traverse vertically along the vertical post; a cam wheel supported by the carriage, the cam wheel operable via the first attachment to create resistance to the first attachment; and a first receiving port extending from the carriage and coupled to the cam wheel, the first receiving port receives the first attachment to couple the first attachment to the cam wheel; a lower cable supported by the cam wheel and extending from the cam wheel to a cable support system, the cable support system extending the lower cable to one or more weights; operation of the first attachment engages the one or more weights to create resistance.

20 Claims, 8 Drawing Sheets

(56) References Cited

U.S. PATENT DOCUMENTS

| | | | | |
|---|---|---|---|---|
| 6,302,833 | B1 | 10/2001 | Ellis et al. | |
| 6,488,612 | B2 | 12/2002 | Sechrest et al. | |
| 6,905,446 | B2 | 6/2005 | Greenland | |
| 7,455,621 | B1 | 11/2008 | Anthony | |
| 7,918,771 | B2 | 4/2011 | Rogers et al. | |
| 11,013,945 | B2 | 5/2021 | Sorin et al. | |
| 11,173,337 | B2 | 11/2021 | Jones et al. | |
| 2007/0203002 | A1 | 8/2007 | Webber | |
| 2010/0152001 | A1 | 6/2010 | Gordon | |
| 2011/0034304 | A1* | 2/2011 | Kuo ..... | A63B 21/0628 482/99 |
| 2013/0184128 | A1 | 7/2013 | Towley, III et al. | |
| 2017/0056707 | A1 | 3/2017 | Hockridge et al. | |
| 2019/0269963 | A1 | 9/2019 | Steenekamp et al. | |

* cited by examiner

CABLE SYSTEM FOR EXERCISE MACHINES

RELATED APPLICATIONS

This application is a continuation-in-part of U.S. patent application Ser. No. 17/955,302, filed Sep. 28, 2022, which is a continuation-in-part of U.S. patent application Ser. No. 17/034,950, filed Sep. 28, 2020, which granted as U.S. Pat. No. 11,517,785, which also claims the benefit of priority from U.S. Provisional Patent Application No. 63/336,679, filed Apr. 29, 2022. The disclosures of each of these applications are incorporated by reference in their entireties herein.

FIELD OF INVENTION

The disclosure relates generally to exercise equipment. More specifically, the disclosure relates to a cable system for use with an exercise machine, the cable system to support one or more attachments for user engagement.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

According to an embodiment of the current disclosure, the invention includes a cable system for use with an exercise machine, the cable system comprising a cable cam for engagement with the exercise machine and to support a first attachment, the cable cam having a carriage to engage with a vertical post as part of the exercise machine, the carriage configured to traverse vertically along the vertical post and secure at a position via one or more locking pins; a cam wheel supported by the carriage, the cam wheel operable via the first attachment to create resistance to the first attachment; and a first receiving port extending from the carriage and coupled to the cam wheel, the first receiving port receives the first attachment to couple the first attachment to the cam wheel; a cable supported by the cam wheel and extending from the cam wheel to a cable support system, the cable support system extending the cable to a weight stack; wherein operation of the first attachment operates the cam wheel such that the cable engages the weight stack to create resistance.

According to another embodiment of the current disclosure, the invention includes an exercise machine with a cable system for providing resistance to a first attachment, the exercise machine comprising a platform for resting on a ground surface; one or more vertical supports extending from the platform; one or more vertical posts extending from the platform; and a cable support system supported by the one or more vertical supports and the one or more vertical posts. The cable system, having a cable cam for engagement with a vertical post to support the first attachment, the cable cam having a carriage to engage with the vertical post, the carriage configured to traverse vertically along the vertical post and secure at a position via one or more locking pins; a cam wheel supported by the carriage, the cam wheel operable via the first attachment to create resistance to the first attachment; and a first receiving port extending from the carriage and coupled to the cam wheel, the first receiving port receives the first attachment to couple the first attachment to the cam wheel; a cable supported by the cam wheel and extending from the cam wheel to the cable support system, the cable support system extending the cable to a weight stack; wherein operation of the first attachment operates the cam wheel such that the cable engages the weight stack to create resistance.

BRIEF DESCRIPTION OF THE DRAWINGS

Embodiments of the invention are described in detail below with reference to the attached drawings.

The drawings do not limit the invention to the specific embodiments disclosed and described herein. The drawings are not necessarily to scale, emphasis instead being placed upon clearly illustrating various principles of the disclosure.

DETAILED DESCRIPTION

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the technology can include a variety of combinations and/or integrations of the embodiments described herein.

Exercise equipment is well known in the art and varies from complex machinery to simple devices, wherein a user may select various equipment based on their needs. Those skilled in the art will recognize that adjustability in exercise equipment is desirable. For example, a user may desire to adjust positions of equipment components to fit their body size, as well as to fit desired movements. In addition, it is desirable for exercise equipment to have a plurality of attachments such that a user can use one machine for a plurality of movements, just by interchanging attachments. Accordingly, the present invention provides for a cable system for use with an exercise machine, wherein the cable system provides for cable resistance and attaches to a machine and provides one or more receiving ports such that a user can select and add one or more attachments to complete a workout as they desire. In addition, the present invention provides for an exercise machine that utilizes the unique cable system and allows a user to not only add various attachments, but also add various user supports, to again further customize their workout as needed. The user can utilize the components discussed herein to complete a number of movements and workouts.

Figure 1:
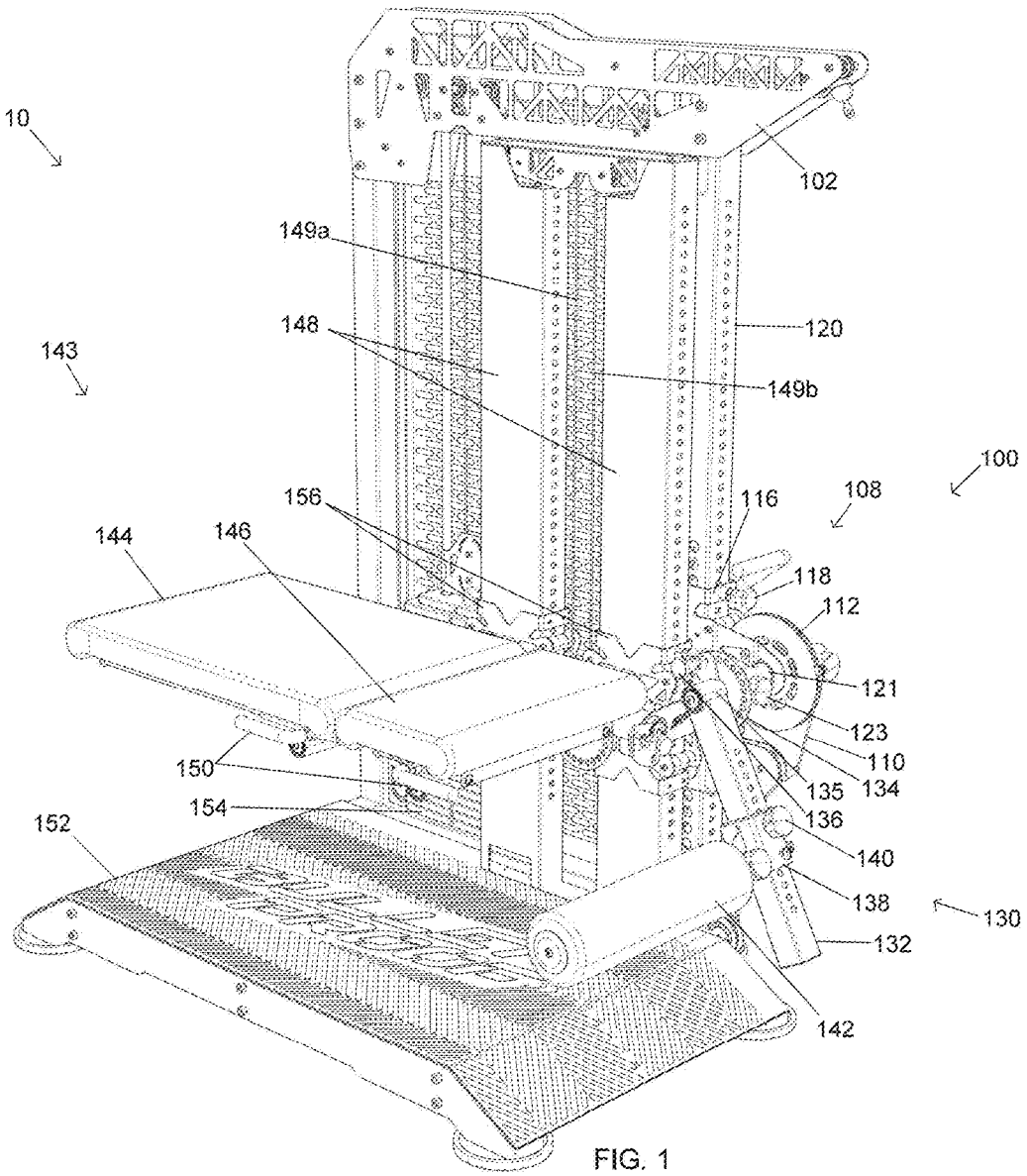
FIG. 1 is a left side angled view of a first exercise machine with a cable system in accordance with the present invention.
Figure 2:
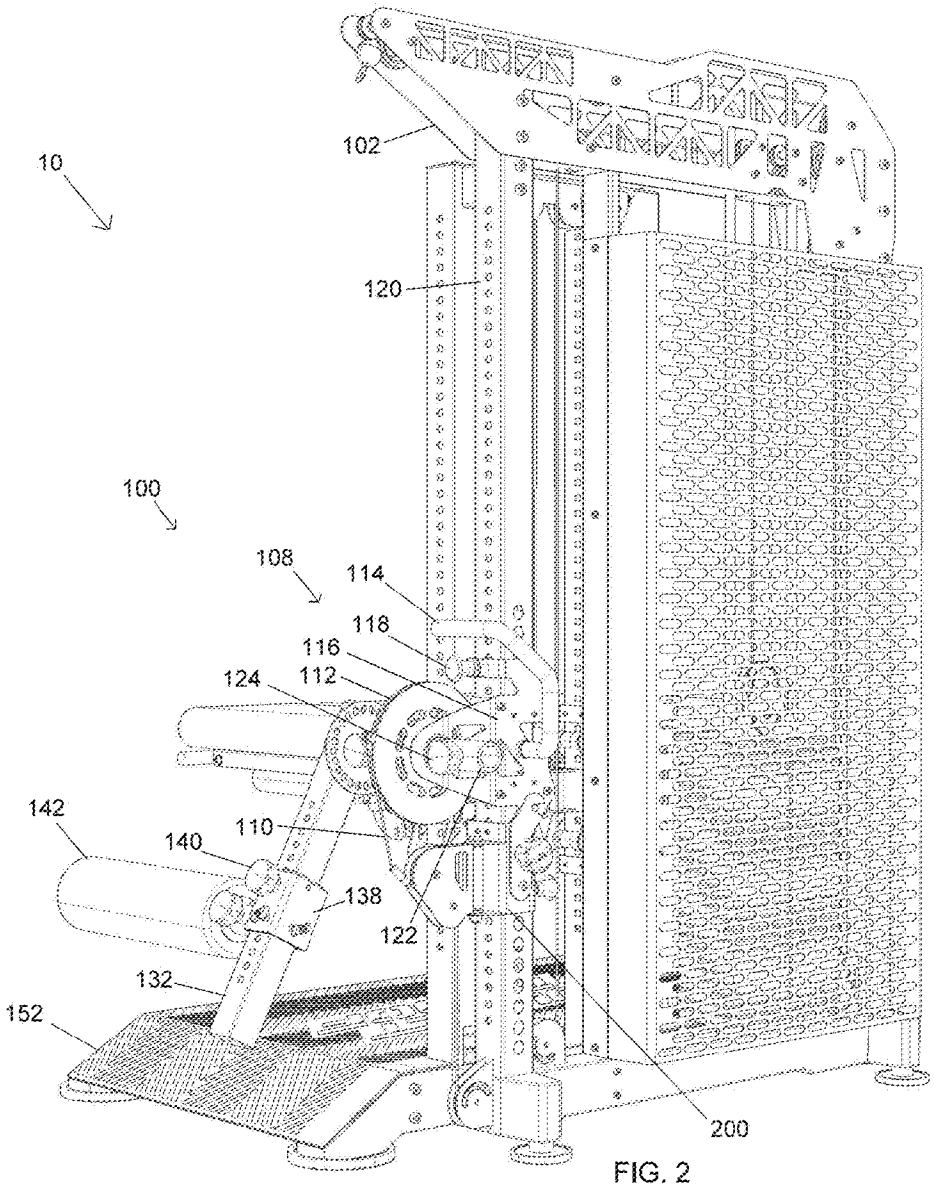
FIG. 2 is right side angled view of the first exercise machine of FIG. 1.

FIGS. 1 and 2 depict a first exercise machine 10 with a cable system 100 in accordance with the present invention. Exercise machine 10 may vary in style and design, while keeping the same core components and functionality. Specifically, machine 10 includes a platform 152 that supports the other components and rests on a ground surface. The platform 152 may include adjustable feet, a non-stick surface, wheels, or other features that would allow for improved functionality. Having the platform 152 support the functional components, allows for all components to take up a small footprint of a gym or home, while still providing for diverse workouts.

The platform 152 supports one or more vertical posts 120 that extend from the platform 152 up to a cable support structure 102. The one or more vertical posts 120 will include a plurality of apertures for receiving components via locking pins, bolts, or other mechanisms as would be known and understood in the art. The cable support structure 102 will be discussed in greater detail in relation to FIGS. 5 and 6 and provides for necessary guides, rollers, and other support structures to support a cable 110 and provide operation of the cable 110 along with a weight stack 154.

The cable system 100 is considered unique to the present invention and is adjustable and able to receive attachments, again providing for a fully customizable machine. The cable system 100 includes a cable cam 108 which is secured to the vertical post 120 and adjustable in height via a carriage 116 and a locking pin 118. The carriage 116 may traverse vertically along the post 120 and lock in a desired position by extending the locking pin 118 through the carriage 116 and one of the apertures. Although only one locking pin 118 is shown, those skilled in the art will appreciate that additional pins and locations of locking may be provided for. In embodiments, a handle 114 may be attached to the carriage 116 to allow for easy user manipulation of the carriage 116. This feature allows for the cable system 100 to be adjusted vertically for operation of a plurality of exercises and also for a plurality of sizes of users. Such adjustment does not require removal of the cable(s) and accordingly is efficient and easy for the user.

The carriage 116 supports a cam wheel 112 which further supports the cable 110. As will be discussed in more detail, the cam wheel 112 rotates such that as a user engages with an attachment, resistance is applied to the attachment through the cam wheel 112, cable 110, and weight stack 154. This is again discussed in detail in FIGS. 5 and 6.

The cable cam 108 further includes one or more receiving ports 121, 122, such as a left side receiving port 121 and a right side receiving port 122. The receiving ports 121, 122 are coupled to the cam wheel 112 such that when an attachment is engaged with one of the receiving ports 121, 122, it is also coupled to the cam wheel 112. In other words, ultimately an attachment will couple to the cam wheel 112. In embodiments, locking pin(s) 123, 124 are used to lock an attachment to an associated receiving port 121, 122. Those skilled in the art will appreciate that alternative means of locking the components together may be used. Further, in embodiments, each of the receiving ports 121, 122 is hexagonal in shape, which creates a tighter engagement with an associated attachment to prevent slippage of the attachment once engaged therewith. However, again, alternative shapes may be used without departing from the present invention.

Machine 10 depicts one contemplated attachment 130 which may be suitable for leg isolator exercises. Attachment 130 includes an arm 132 that extends from a first end to a second end, wherein the first end is coupled to a pivoting connector 135 which is further coupled to the receiving port 121. Accordingly, attachment 130 is ultimately coupled to the receiving port 121 and the cam wheel 112. In embodiments, the pivoting connector 135 allows for the arm 132 to pivot there-around, such that another locking pin 136 can lock the arm 132 at a desired angle with a plate 134. In other words, the user can pivot the arm 132 around the pivoting connector 135 until they reach a comfortable and/or desired angle, and then use pin 136 to lock into an aperture of the plate 134 and lock in the angle.

Attachment 130 further includes a user engageable device 142, which in embodiments is a pad as shown, however, the user engageable device 142 may be a handle, bar, or other configured device. The user engageable device 142 is coupled to the arm 132 via an attachment carriage 138 and another locking pin 140 or other locking mechanism. Again, this configuration allows for the user engageable device 142 to be selectively positioned along the arm 132 to fit the user's needs.

In some embodiments, a lower cable pulley system 200 is further used and engages with the cable 110 and the cable cam 108. This will also be discussed in detail in FIGS. 7 and 8.

Machine 10 further includes a user support system 143 for supporting the user, such as in a seated or lying down position. In exemplary embodiments, the user support system 143 includes a first support 144 and a second support 146, each further including adjustment mechanisms 150 such that the supports 144, 146 are adjustable relative to one another. For example, the user may raise support 144 upwards, thereby creating a seated configuration. In embodiments, the user supports 144, 146 are coupled to adjustable anchors 156, which are further coupled to vertical supports 148. Accordingly, the user support system 143 is suspended above the platform 152. The adjustable anchors 156 can be selectively secured at a vertical height, again providing the user with full customization. In embodiments, a second cable 149*a* and a third cable 149*b* are used in connection with the user support system 143 for providing counterweight to the user supports. This is discussed in detail in relation to FIG. 6 below.

Figure 3:
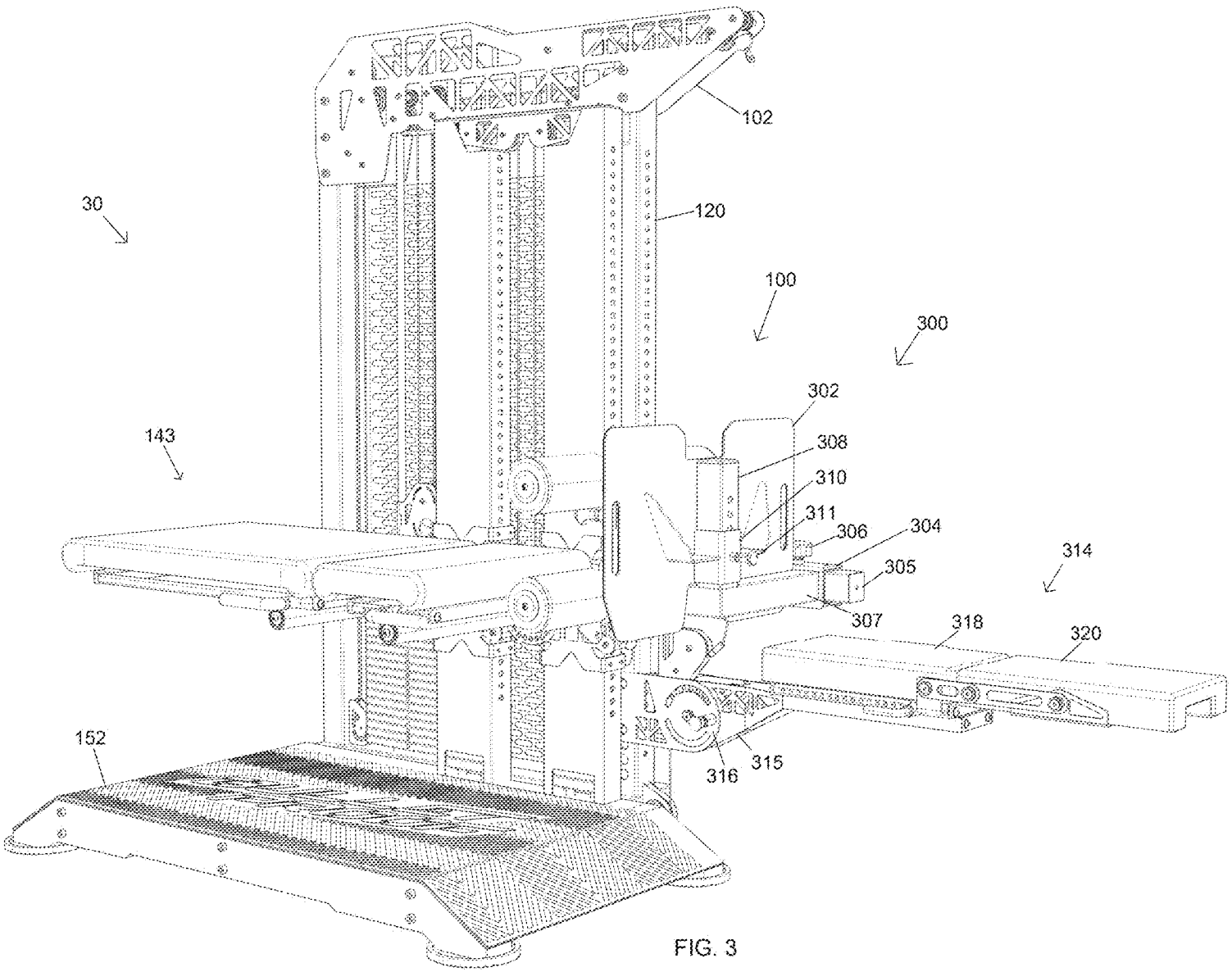
FIG. 3 is left side angled view of a second exercise machine with the cable system in accordance with the present invention.
Figure 4:
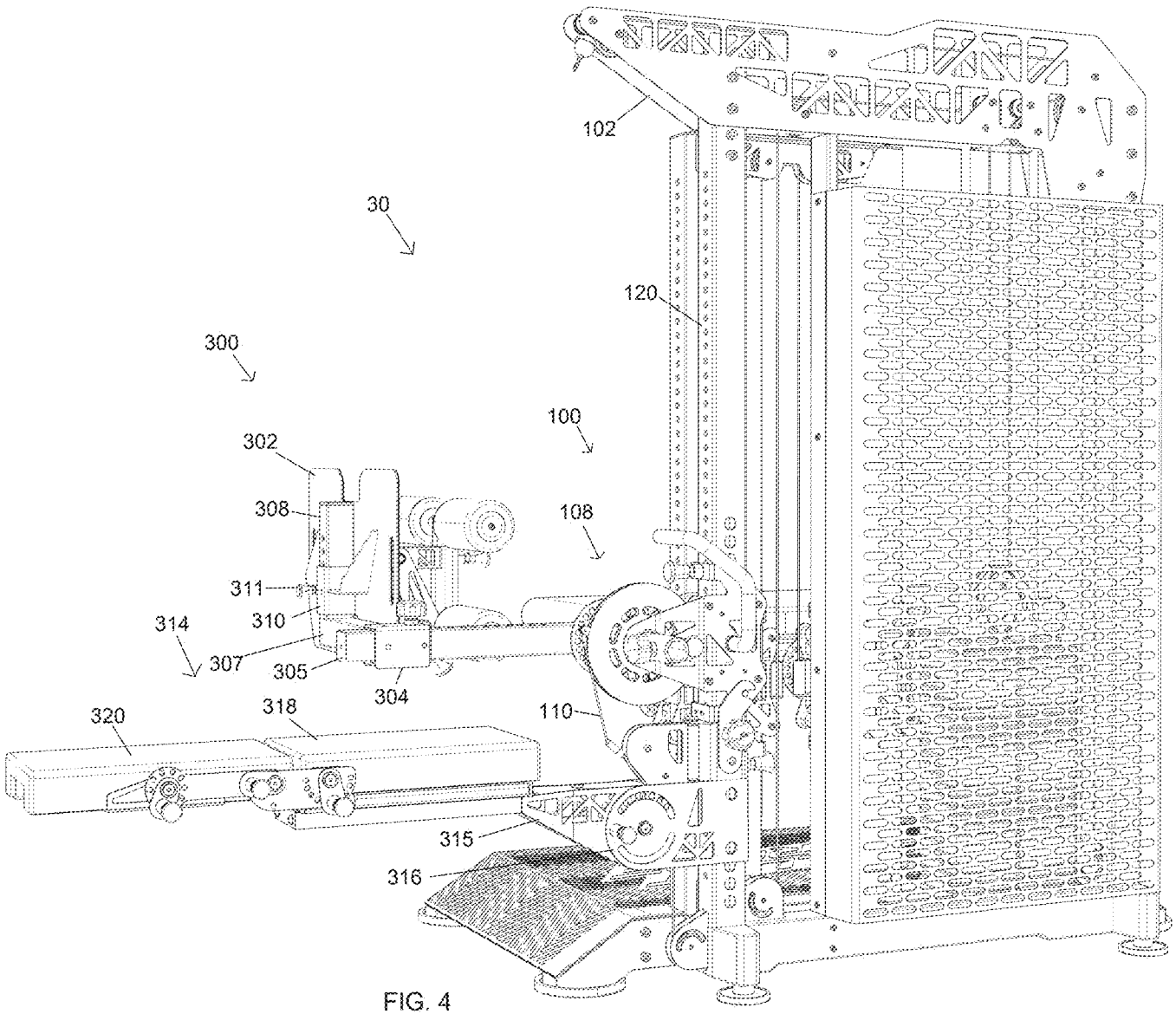
FIG. 4 is a right side angled view of the exercise machine of FIG. 3.

FIGS. 3 and 4 depict another embodiment of an exercise machine 30 having the same cable system 100 discussed above. Machine 30 depicts another example of an attachment 300. In this example, an arm 305 extends from a first end to a second end, the first end engaged with a receiving port 121 via a connector (not shown). An attachment carriage 304 is engaged with the arm 305 and is configured to secure at a position along the arm 305 via a locking pin 306. Attachment 300 further includes a horizontal support bar 307 engaged with the attachment carriage 304 and extends to a vertical support bar 308. In other words, two support bars 307, 308 are provided and positioned at a substantial right angle relative to one another. A foot plate 302 is supported by the vertical support bar 308 and another carriage 310 and locking pin 311, again allowing for the foot plate to be raised or lowered.

Machine 30 further includes another user support system 314 having a support brace 315 adjustable via a plate 316.

The support brace 315 extends to a first pad 318 and a second pad 320, again the pads 318, 320 being adjustable relative to one another via any number of adjustment mechanisms.

Those skilled in the art will appreciate that the various attachments shown are exemplary and may be used together, sperate, or with other attachments, utilizing the unique cable system 100 of the present invention for improved customization and functionality.

Figure 5:
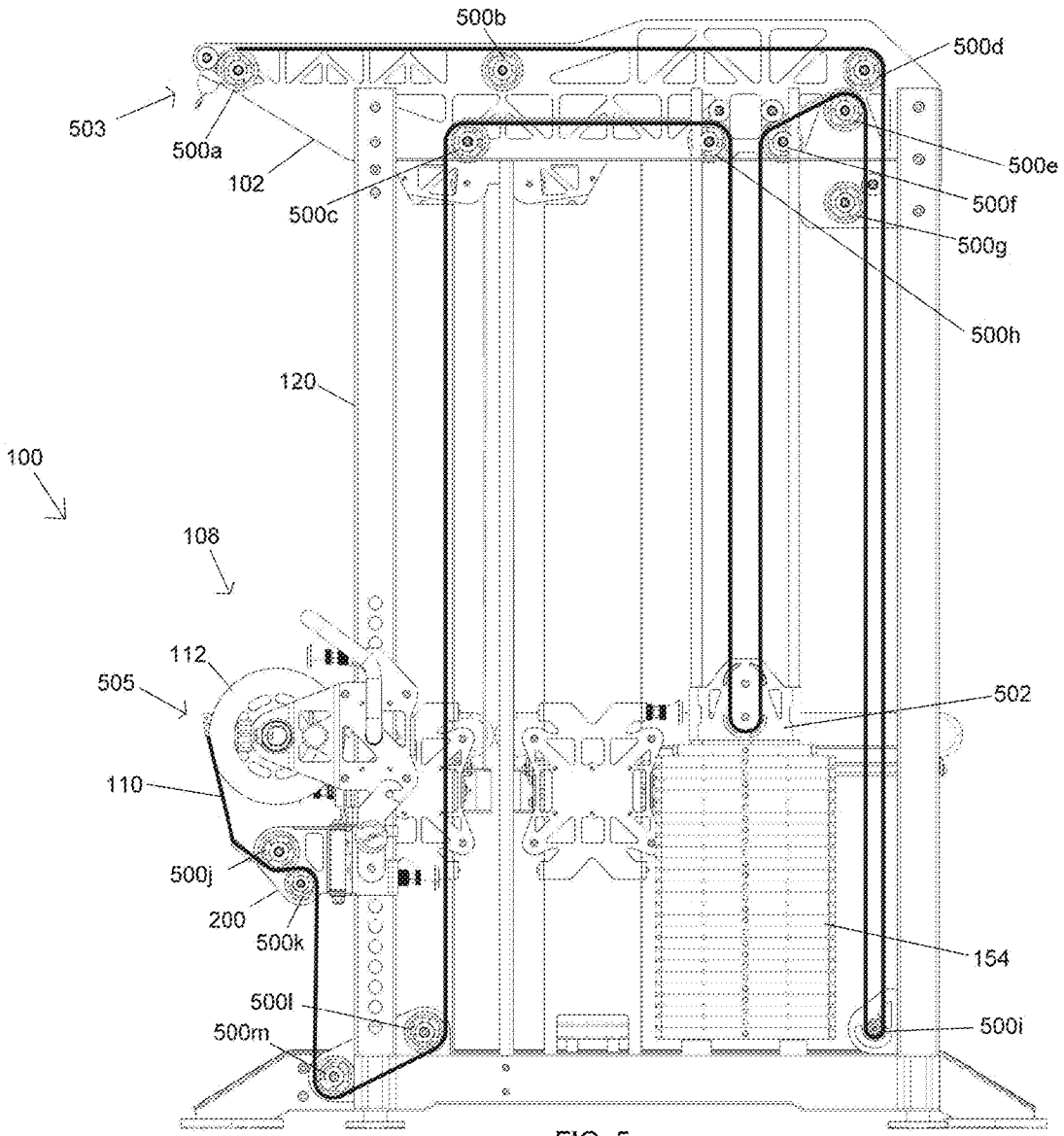
FIG. 5 is a side view of a first cable support system in accordance with the present invention.

In FIG. 5, the support and operation of cable 110 is shown. Cable 110 is supported by the cam wheel 112 and travels from the cam wheel to a plurality of guides 500*a-m* which ultimately guide the cable 110 to weight stack 154 such that the cable 110 engages with the weight stack 154 via a weight support structure 502. The cable 110 is engaged with the weight stack 154 at a middle region of the cable 110 as shown, as opposed to at an end, this feature allows for both ends 503, 505 to be engaged by a user. For example, the user may engage with an attachment extending from cable cam 108 such that rotation of the cam wheel 112 pulls on end 505 and accordingly engages the weight stack 154 such that resistance is created. Alternatively, the user may engage with end 503, such as by adding a handle (not shown) or other attachment, and pull downwards, thereby again causing the cable to engage with weight stack 154 for created resistance. This configuration is considered unique to the present invention.

Figure 6:
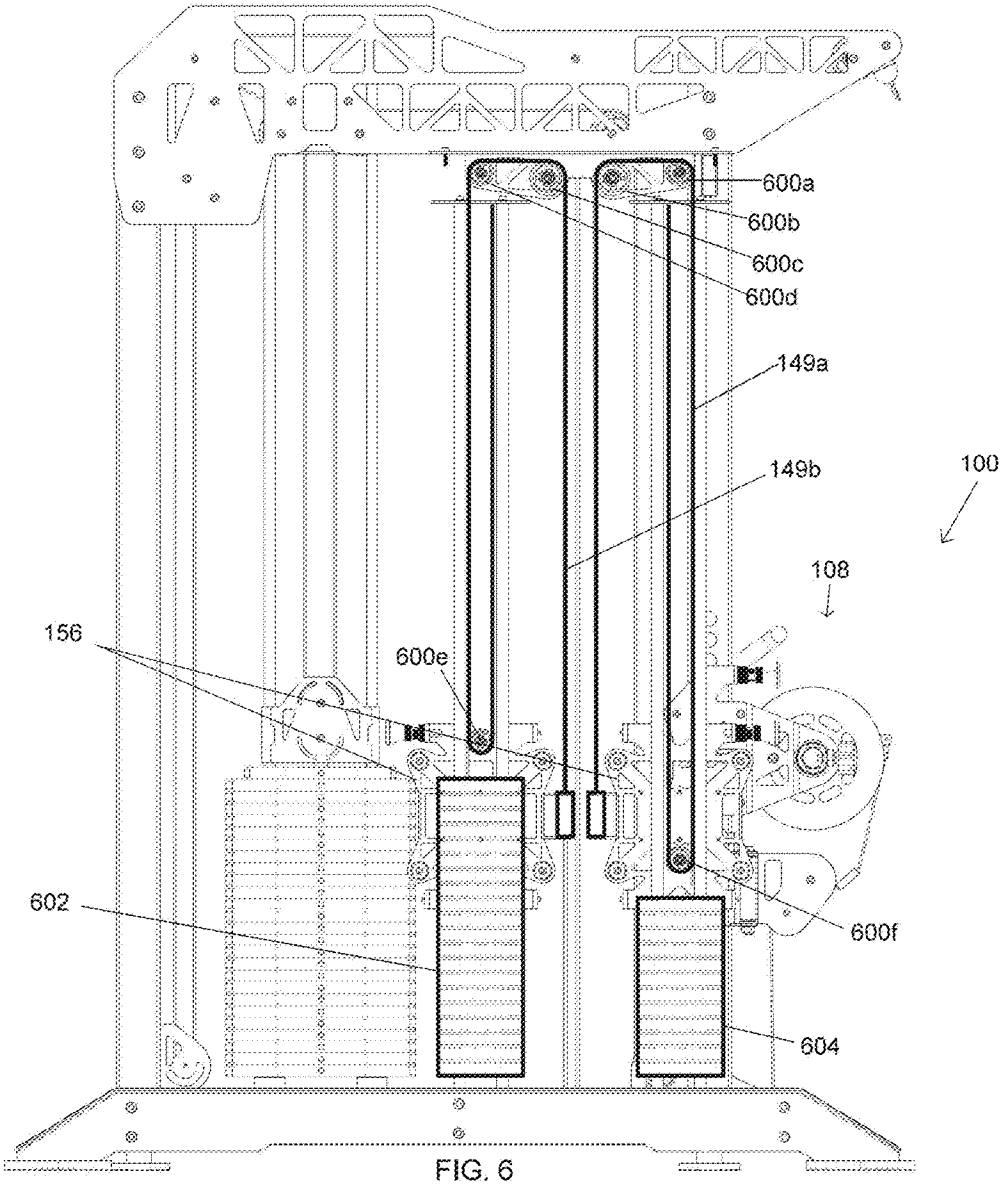
FIG. 6 is side view of a second cable support system in accordance with the present invention.

In FIG. 6, the support and operation of the secondary cables 149*a-b* is shown. Again, these cables 149*a-b* are supported via a number of guides 600*a-f* such that they are further engaged with secondary weight stacks 602, 604. Secondary weight stacks 602, 604 provide counterweight to the user support system 143 (see FIG. 1). by being coupled to adjustable anchors 156.

Figure 7:
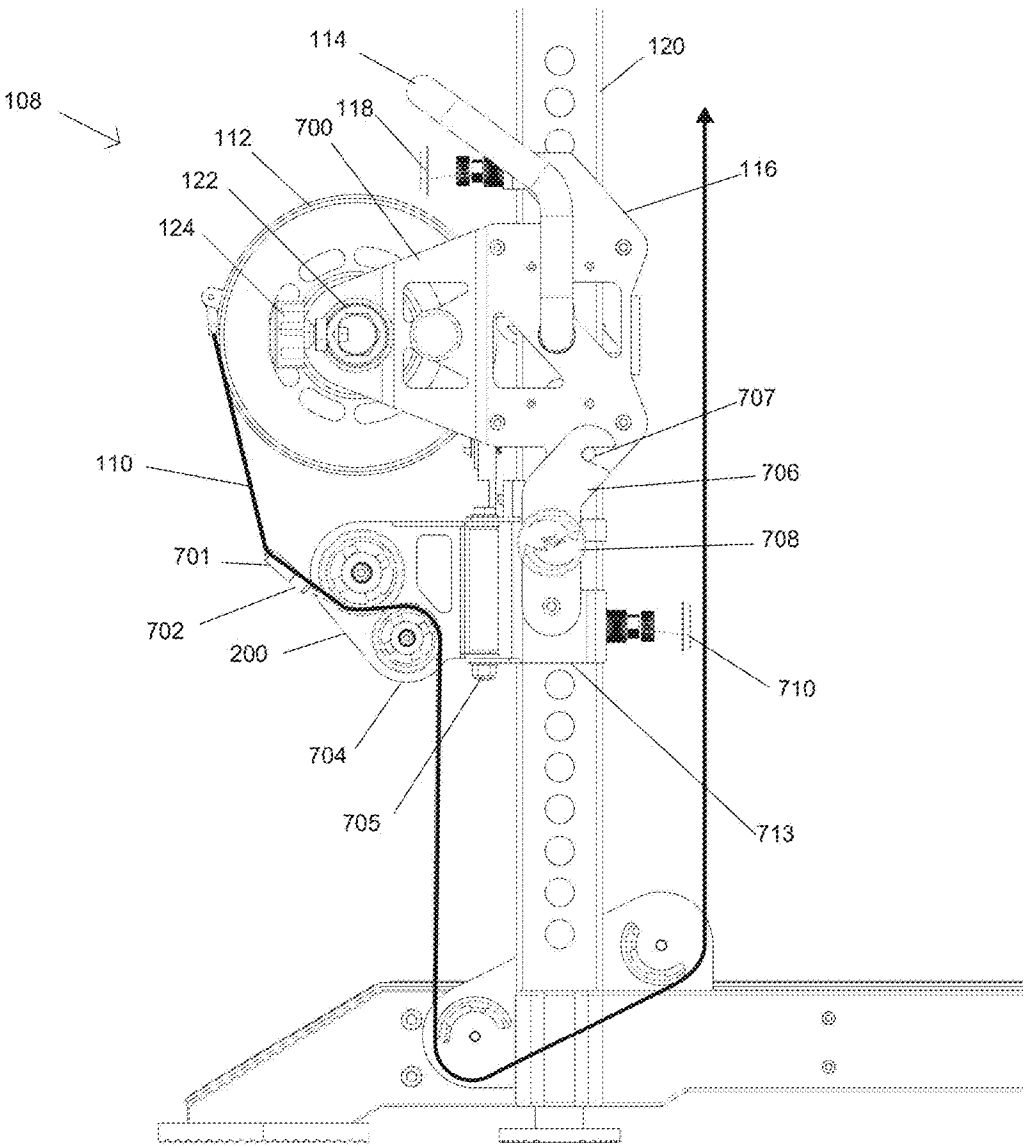
FIG. 7 is a side view of a cable cam and a low cable pulley system in an attached configuration in accordance with the present invention.
Figure 8:
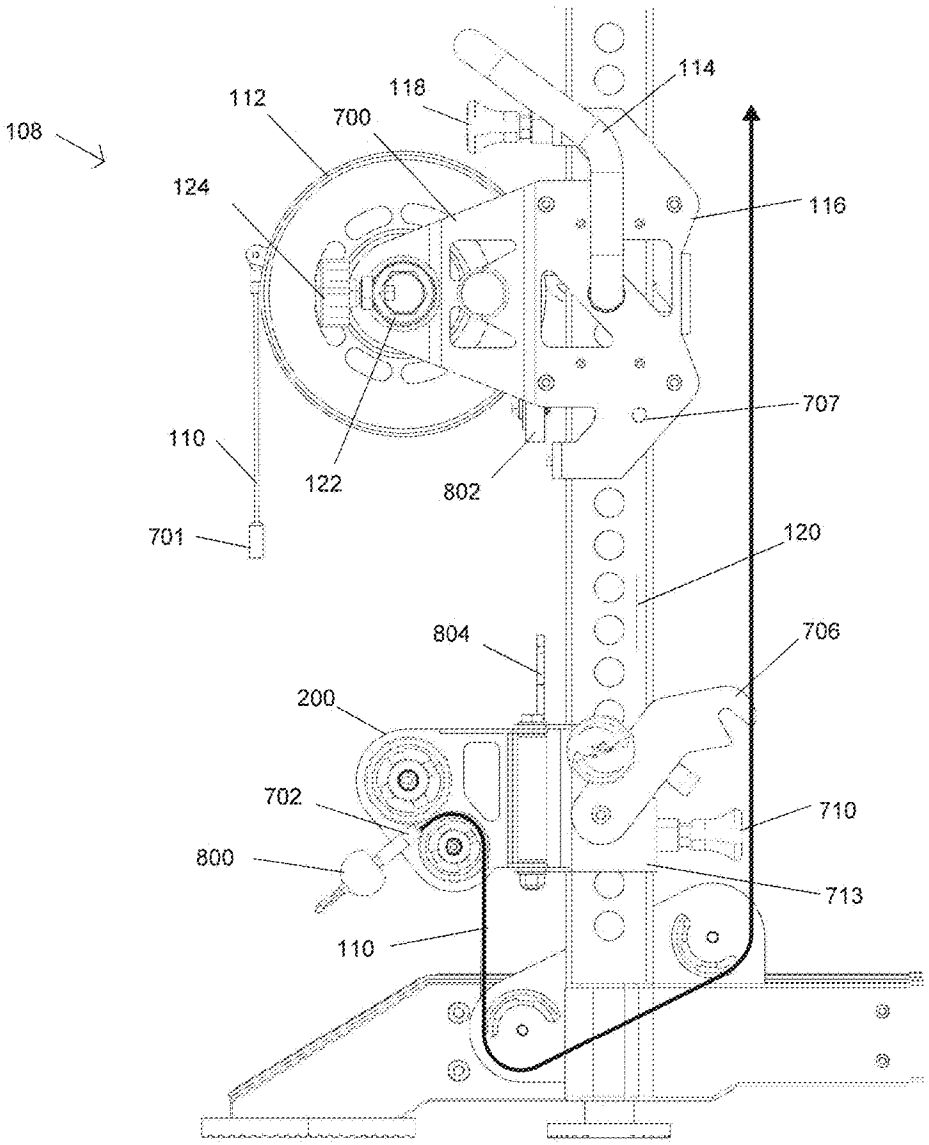
FIG. 8 is a side view of the cable cam and the low cable pulley system in a detached configuration in accordance with the present invention.

In FIGS. 7 and 8, the cable cam 108 and lower cable pulley system 200 are shown in detail. As discussed above, the cable cam 108 includes the carriage 116 secured to the post 120 via the locking pin 118. The carriage 116 in embodiments includes two side brackets, as represented with bracket 700, the side brackets having the cam wheel 112 positioned therebetween and configured to couple the receiving ports 121, 122 to the cam wheel 112. Those skilled in the art will appreciate that the exact shape and configuration of the carriage 116 may vary based on manufacturing, functional, or aesthetic considerations.

The lower cable pulley system 200 is an optional system that can be used to further support cable 110 such that a user can disengage the cable 110 at threaded cylindrical cable connectors 701, 702. In the disconnected configuration, shown in FIG. 8, the user may attach an attachment, such as a handle, to a ball stop 800, and perform one or more exercises without using the cable cam 108. The lower cable pulley system 200 includes a housing 704 engaged with a carriage 713 via a pivoting connector 705. The housing 704 is configured to support the cable 110 as it travels therethrough. The carriage 713 is again configured to be adjustable along post 120 via a locking pin 710. A rotating hook 706 is provided with a lock 708 such that the rotating hook 706 can rotate to engage with a catch pin 707 to lock the lower cable pulley system 200 to the carriage 116. Embodiments further include a connector 804 and a receiver 802 to lock the lower cable pulley system 200 to the carriage 116. Again, as best shown in FIG. 8, the user can disengage with threaded cylindrical cable connectors 701, 702 such that the cable 110 becomes disengaged from the cable cam 108 and supported by the lower cable pulley system 200.

The cable system of the present invention is unique by providing numerous configurations to allow for a user to add a plurality of different attachments, make adjustments based on their size and needs, and perform a number of exercises. Accordingly, the user can use the cable system of the present invention for a complete workout.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations. Not all steps listed in the various figures need be carried out in the specific order described.

The invention claimed is:

1. A cable system for use with an exercise machine, the cable system comprising:

a cable cam for engagement with the exercise machine and to support a first attachment, the cable cam having:

a carriage to engage with a vertical post as part of the exercise machine, the carriage configured to traverse vertically along the vertical post and secure at a position via one or more locking pins;

a cam wheel supported by the carriage, the cam wheel operable via the first attachment to create resistance to the first attachment; and a first receiving port extending from the carriage and coupled to the cam wheel, the first receiving port receives the first attachment to couple the first attachment to the cam wheel; and a cable supported by the cam wheel and extending from the cam wheel to a cable support system, the cable support system extending the cable to a weight stack;

wherein operation of the first attachment operates the cam wheel such that the cable engages the weight stack to create resistance.

2. The cable system of claim 1, further comprising:

the first receiving port extending from the carriage on a first side of the carriage; and a second receiving port extending from the carriage on a second side of the carriage.

3. The cable system of claim 2, wherein the first receiving port has a hexagonal opening.

4. The cable system of claim 1, wherein the first attachment further comprises:

an arm extending from a first end to a second end, the first end engaged with the first receiving port via a pivot connector, the arm configured to pivot about the pivot connector and lock at an angle via a second locking pin and a plate with a plurality of apertures;

an attachment carriage engaged with the arm and configured to secure at a position along the arm via a third locking pin; and a user engageable device supported by the attachment carriage and extending therefrom;

wherein a user engages with the user engageable device to operate the attachment.

5. The cable system of claim 4, wherein the user engageable device is a pad.

6. The cable system of claim 1, wherein the first attachment further comprises:

an arm extending from a first end to a second end, the first end engaged with the first receiving port via a connector;

an attachment carriage engaged with the arm and configured to secure at a position along the arm via a third locking pin;

a horizontal support bar engaged with the attachment carriage and extending therefrom;

a vertical support bar engaged with the horizontal support bar and extending therefrom; and a foot plate supported by the vertical support bar;

wherein the foot plate is configured to be operated by a user.

7. The cable system of claim 6, wherein the foot plate is vertically adjustable along the vertical support bar via a foot plate carriage.

8. The cable system of claim 1, further comprising:

a handle attached to and extending from the carriage.

9. The cable system of claim 1, further comprising:

a lower cable pulley system, having:

a lower cable pulley system carriage for adjustably engaging with the vertical post;

a rotating hook configured to connect the lower cable pulley system carriage to the carriage of the cable cam;

a housing coupled to the lower cable pulley system carriage and configured to support the cable; and a two sided threaded cylindrical cable connector configured to create a disconnect along the cable.

10. An exercise machine with a cable system for providing resistance to a first attachment, the exercise machine comprising:

a platform for resting on a ground surface;

one or more vertical supports extending from the platform;

one or more vertical posts extending from the platform; and a cable support system supported by the one or more vertical supports and the one or more vertical posts;

the cable system, having:

a cable cam for engagement with a vertical post to support the first attachment, the cable cam having:

a carriage to engage with the vertical post, the carriage configured to traverse vertically along the vertical post and secure at a position via one or more locking pins;

a cam wheel supported by the carriage, the cam wheel operable via the first attachment to create resistance to the first attachment; and a first receiving port extending from the carriage and coupled to the cam wheel, the first receiving port receives the first attachment to couple the first attachment to the cam wheel; and a cable supported by the cam wheel and extending from the cam wheel to the cable support system, the cable support system extending the cable to a weight stack;

wherein operation of the first attachment operates the cam wheel such that the cable engages the weight stack to create resistance.

11. The exercise machine of claim 10, further comprising:

the first receiving port extending from the carriage on a first side of the carriage; and a second receiving port extending from the carriage on a second side of the carriage.

12. The exercise machine of claim 11, wherein the first receiving port has a hexagonal opening.

13. The exercise machine of claim 10, wherein the first attachment further comprises:

an arm extending from a first end to a second end, the first end engaged with the first receiving port via a pivot connector, the arm configured to pivot about the pivot connector and lock at an angle via a second locking pin and a plate with a plurality of apertures;

an attachment carriage engaged with the arm and configured to secure at a position along the arm via a third locking pin;

a user engageable device supported by the attachment carriage and extending therefrom;

wherein a user engages with the user engageable device to operate the attachment.

14. The exercise machine of claim 13, wherein the user engageable device is a pad.

15. The exercise machine of claim 10, wherein the first attachment further comprises:

an arm extending from a first end to a second end, the first end engaged with the first receiving port via a connector;

an attachment carriage engaged with the arm and configured to secure at a position along the arm via a third locking pin;

a horizontal support bar engaged with the attachment carriage and extending therefrom;

a vertical support bar engaged with the horizontal support bar and extending therefrom; and a foot plate supported by the vertical support bar;

wherein the foot plate is configured to be operated by a user.

16. The exercise machine of claim 15, wherein the foot plate is vertically adjustable along the vertical support bar via a foot plate carriage.

17. The exercise machine of claim 10, further comprising:

a user support system supported by the one or more vertical supports, the user support system having:

a first anchor engaged with a first of the one or more vertical supports;

a second anchor engaged with a second of the one or more vertical supports;

a first user support extending from the first anchor; and a second user support extending from the second anchor.

18. The exercise machine of claim 10, further comprising:

a handle attached to and extending from the carriage.

19. The exercise machine of claim 10, further comprising:

a lower cable pulley system, having:

a lower cable pulley system carriage for adjustably engaging with the vertical post;

a rotating hook configured to connect the lower cable pulley system carriage to the carriage of the cable cam; and a housing coupled to the lower cable pulley system carriage and configured to support the cable; and a two sided threaded cylindrical cable connector configured to create a disconnect along the cable.

20. The exercise machine of claim 10, further comprising:

a user support system engaged with the vertical post and extending therefrom, the user support system having a first pad and a second pad, the first pad and the second pad adjustable relative to one another.

* * * * *